United States Patent [19]

Ecker

[11] 4,411,307

[45] Oct. 25, 1983

[54] WOUND TUBE HEAT EXCHANGER

[75] Inventor: Amir L. Ecker, Duncanville, Tex.

[73] Assignee: Atlantic Richfield Company, Los Angeles, Calif.

[21] Appl. No.: 229,331

[22] Filed: Jan. 29, 1981

[51] Int. Cl.[3] ..... F28D 7/02

[52] U.S. Cl. ..... 165/70; 165/164

[58] Field of Search ..... 165/70, 164, 140; 29/521, 522 R, 523, 525, 157.3 AH

[56] References Cited

U.S. PATENT DOCUMENTS

| | | | |
|---|---|---|---|
| 1,823,919 | 9/1931 | Smith | 165/164 |
| 2,004,389 | 6/1935 | Jones | 29/157.3 AH |
| 2,340,926 | 2/1944 | Bradley | 165/164 |
| 2,621,903 | 12/1952 | Cohler | 165/164 |
| 3,739,842 | 6/1973 | Whalen | 165/164 |
| 4,194,536 | 3/1980 | Stine et al. | 165/164 X |
| 4,316,502 | 2/1982 | Sanborn et al. | 165/164 X |

FOREIGN PATENT DOCUMENTS

| | | | |
|---|---|---|---|
| 224102 | 5/1958 | Australia | 165/164 |
| 1332607 | 12/1963 | France | 165/164 |

*Primary Examiner*—Sheldon J. Richter

*Attorney, Agent, or Firm*—Wofford, Fails & Zobal

[57] ABSTRACT

What is disclosed is a wound tube heat exchanger in which a plurality of tubes having flattened areas are held contiguous adjacent flattened areas of tubes by a plurality of windings to give a double walled heat exchanger. The plurality of windings serve as a plurality of effective force vectors holding the conduits contiguous heat conducting walls of another conduit and result in highly efficient heat transfer. The resulting heat exchange bundle is economical and can be coiled into the desired shape. Also disclosed are specific embodiments such as the one in which the tubes are expanded against their windings after being coiled to insure highly efficient heat transfer.

2 Claims, 6 Drawing Figures

WOUND TUBE HEAT EXCHANGER

FIELD OF THE INVENTION

This invention relates to heat exchangers; and, more particularly, to heat exchangers that are operable as double walled heat exchangers such as are employed for exchanging heat between fluids where the fluids must be kept separated for safety.

DESCRIPTION OF THE PRIOR ART

The prior art is replete with a wide variety of heat exchangers. There are many applications where double walled heat exchangers are necessary for safety. For example, if hot and cold liquids are to have heat exchanged therebetween and contamination of one of the liquids by the other is impermissible for safety reasons or the like, a double walled heat exchanger is necessary. The double walled heat exchanger must have the flexibility of showing any leak that develops, rather than have the fluid flow into the contiguous flow path of the other fluid. One application where this has assumed significance in view of the recent energy shortage is in the field of solar collectors wherein a glycol solution may be heat exchanged with potable water, such as in the hot water heater of a home or the like. The heat exchangers that have been supplied to meet these requirements have been expensive and have required metallic bonding of conduits, casting, extrusion, and other such expensive approaches. One of the more pertinent patents is U.S. Pat. No. 2,621,903, issued Dec. 16, 1952, for "Heat Exchange Tubing". In that patent there is described a heat exchanger in which parallel cylindrical tubes are bonded together and have a metallic banding bonded to the tubes for conducting heat therebetween. Even this approach did not provide a totally satisfactory answer, however, since the following types of problems were encountered with the prior art type heat exchangers. (1) Where the tubes and the windings were bonded together by brazing or soldering, high temperature manufacturing operations were required. (2) Separate bonding operations were required for bonding the windings to the tubes and for bonding the tubes together. (3) The prior art type double walled heat exchangers were very difficult to manufacture and were, consequently, expensive. (4) The prior art type double walled heat exchangers did not employ the minimum amount of tube and wrap, or winding, material. (5) The prior art type double walled heat exchangers relied too much on heat transfer by way of the relatively long distances of the bonded metallic winding and were not as efficient as desired. (6) The prior art double walled heat exchanger was not easily insulated. (7) The contact area could not be made proportional to tube size since there was always only a line contact between the cylindrical tubes. (8) The rounded cross section of the prior art gave minimum surface area for heat transfer for the cross sectional area of flow. (9) The windings always needed to be bonded to the tubing for rigidity. (10) The bonded together tubing did not satisfy double walled criteria in that it was possible to have pit corrosion from one fluid to the other so that a leak would not show on the exterior of the tubes.

From the foregoing it is apparent that it is desirable that the double walled heat exchangers have the following features not heretofore provided in the prior art. (1) The double walled heat exchangers should be prepared with a minimum of high temperature manufacturing operations and should eliminate having to braze or solder tubes together. (2) The double walled heat exchanger should eliminate separate bonding operations for the wrapping other than fastening of the wrapping to the tubes over periodic intervals to prevent unwinding. (3) The double walled heat exchanger should be simple to manufacture. (4) The double walled heat exchanger should employ a minimum amount of tube and winding material. (5) The double walled heat exchanger should have a short path of flow for the heat and be efficient in heat transfer. (6) The double walled heat exchanger should be easily insulated by conventional, economical insulation. (7) The double walled heat exchanger should have a contact area that can be made proportional to tube size and have the relatively much larger area of contact between contiguous tubes than a mere line contact between cylindrical tubes. (8) The double walled heat exchanger should have a relatively large surface area for heat transfer in proportion to the cross sectional area of tubing flow path defined interiorly of the tubing. (9) The winding should have a plurality of windings spirally wrapped per unit length to mechanically constrain multiple tubes of heat conductive material together to form the double walled heat exchanger design but should not be bonded to the tubes for rigidity but allow the tubes and resulting double walled heat exchanger to be coiled into a desired design. The tubes should be held closely contiguous adjacent tubes for efficient heat transfer by conduction. In specific embodiments, the tubes should have heat conduction by way of heat conductive plurality of windings that act like extended fins where the conduction heat path is greatly shortened compared to the prior art type heat exchangers that served as double walled heat exchangers. (10) The double walled heat exchangers should satisfy the criteria for double walled heat exchangers and not allow pit corrosion through solder joints or the like; but should, instead, allow any leaking fluid to be vented to the exterior where it is detectable. (11) The heat exchanger should enable employing malleable, soft wall, highly heat conductive tubing and enable employing thin wall conventional tubing rather than much more expensive thick walled tubing. (12) The heat exchanger should be bendable into a compact design that will effect the heat transfer equivalent for much larger space requiring conventional heat exchanger. The double walled heat exchanger should, in specific embodiments, be expanded out into contact with the windings so as to provide advantageous flow patterns and highly efficient transfer of heat. (13) The heat exchanger should decrease the amount of material and expense compared to a conventional heat exchanger.

SUMMARY OF THE INVENTION

Accordingly, it is an object of this invention to provide a heat exchanger that has one or more of the features delineated hereinbefore as desirable but not heretofore provided.

It is a specific object of this invention to provide a heat exchanger having substantially all of the features delineated hereinbefore as desirable and not heretofore provided.

These and other objects will become apparent from the descriptive matter hereinafter, particularly when taken in conjunction with the appended drawings.

In accordance with one embodiment of this invention, there is provided a double walled heat exchanger comprising:

a. a plurality of discrete conduits defining separate flow paths for respective fluids; the conduits having thin, heat conductive walls and being disposed contiguous another of the conduits; the conduits having respective flattened areas emplaced contiguous each other for significant area that can be proportional to tube size; rather than a mere line contact; and b. a plurality of windings holding the plurality of conduits in a bundle; the plurality of windings reinforcing the thin, heat conductive walls and having a plurality of tensile forces compressively holding the plurality of conduits contiguous adjacent conduits with a plurality of effective force vectors per unit of length.

In accordance with another embodiment of this invention there is provided a method of forming a double wall heat exchanger characterized by the steps of:

a. emplacing a plurality of discrete conduits defining separate flow paths for respective fluids, with one conduit contiguous another; the conduits having thin, heat conductive walls; and having respective flattened areas emplaced contiguous each other for significant contact area rather than a mere line contact;

b. wrapping a plurality of windings about the conduits with tensile wrapping force and a plurality of turns per unit length such that the conduits are held in a unitary bundle; and c. affixing the windings to the conduits only at intervals necessary to prevent unwinding and not continuously.

In a preferred embodiment said unitary bundle is coiled into a desired shape and the conduit are hydraulically expanded subsequently to force their thin, heat conductive walls of said conduits contiguous adjacent conduits and windings for effective heat transfer capability.

DESCRIPTION OF THE PREFERRED EMBODIMENTS

It is to be borne in mind that this invention can be useful in a wide variety of applications. For example, it is employable in heat exchanging solar heat exchange fluid, such as ethylene glycol solution, with potable hot water or the like. Conversely, it is useable in heat exchanging with a refrigerant in a heat pump system; operative either in the heating or cooling cycle in which either heating capacity or cooling capacity is supplied to the refrigerant by a fluid, such as a liquid like water. Many other applications will come to mind. For purposes of explanation, this invention will be described with respect to exchanging heat between a solar heating fluid solution such as ethylene glycol in aqueous solution and a potable water such as hot water in a hot water storage tank.

The invention can be understood by referring to FIGS. 1-4. Therein the heat exchanger 11 includes a plurality of discrete conduits 13, 15 defining separate flow paths for the respective fluids; and a plurality of windings 17 holding the plurality of conduits in a bundle.

Figure 1:
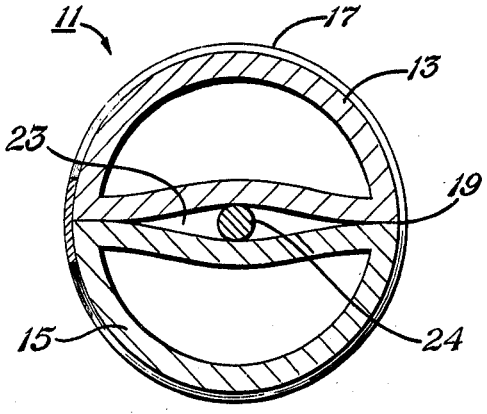
FIG. 1 is a cross sectional view of a preferred embodiment of this invention.

The conduits 13, 15 are disposed in parallel longitudinal relationship with each other. It is preferred that they not be bonded together, since the bond affords a potential leak path to enable one fluid to contaminate another without the leaking fluid being sighted. The conduits 13, 15 have relatively thin walls of a heat conductive material. The heat conductive materials may be, for example, steel, copper, aluminum or the like. Copper is ordinarily preferred when aqueous solutions are employed because of its relative non-corrosivity to aqueous fluids. One of the advantages of this invention is that soft annealed copper tubing or the like can be employed and by the time the working is finished, it will become higher strength hard copper tubing that will retain its coiled shape well. As illustrated in FIG. 1, the D-shape can be formed into the tubing before it is purchased such that the D-tubes are bought in continuous rolls and employed to make the heat exchangers; or it can be formed by rolling a flat spot onto the conventional cylindrical tube of circular cross section. As illustrated, the tubes 13, 15 have two significant areas of contact 19, 21 that can be proportional to tube size. If desired, the relatively flattened areas of the D may be substantially straight, or flat, instead of bowed interiorly. If flat, a lineal object such as wire 24, FIG. 1, can be emplaced to keep an open path 23. The advantage of having the open path 23 is that fluids that leak can be detected. This prevents contamination of a fluid such as the potable water. If desired a heat conductive compound may be employed in the center intermediate the back to back flattened areas. For example, Dow Corning silicone has a heat conductive compound, as does Honeywell, Inc., that is non-hardening, so leaks of water or the like will still be brought to be visible to the observer to reveal the leak rather than have it corroded completely into the other contiguous conduit. Such heat conductive compound is not pressurized but allows the force of the windings to hold the conduits with their flattened areas contiguous for highly efficient heat transfer.

Figure 2:
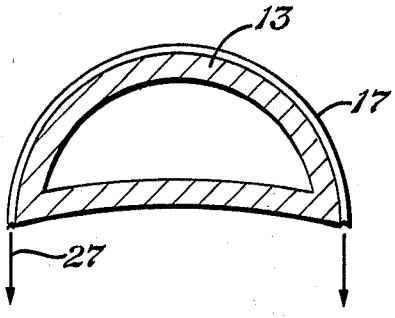
FIG. 2 is partial cross sectional view, partly schematic, of the top half of the embodiment of FIG. 1 illustrating the effective force vectors provided by the plurality of windings.
Figure 4:
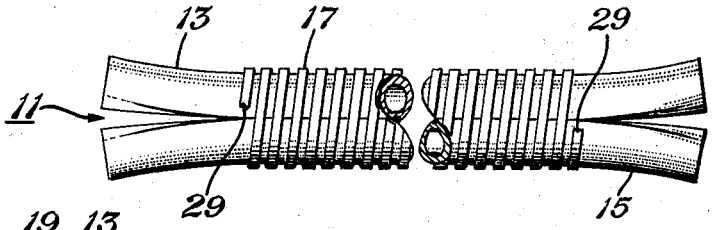
FIG. 4 is a partial side elevational view, partially discontinuous, showing the heat exchanger of FIG. 1.
Figure 3:
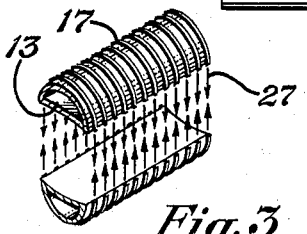
FIG. 3 is a partial isometric view, partly schematic, showing the heat exchanger of FIG. 1 with the effective force vectors.

The windings 17 comprise helically wound linear members around the tubes to form an encompassing series of effective force vectors that cause the copper tubes to be pressed together at least along their contiguous lines of contact 19 and 21. As can be seen in FIGS. 2 and 3, a plurality of effective force vectors, shown by the arrows 27 force the conduits together to insure effective heat transfer from one fluid to the other by conduction. As will be apparent, if tensile force of 50 to 100 pounds is exerted along the winding 17 as it is wound around the tubes, each of the force vectors then represent the 50 to 100 pounds. Thus if there are five windings per inch then the conduits are held together by up to a thousand pounds force, or 250 pounds of force vectors in both upward and downward directions along each side. If there are eight turns of winding per inch, it is apparent that there will be sixteen force vectors per side per inch of length. Thus if only twenty pounds force is used in winding, there will be three hundred and twenty pounds of force per side or a total of six hundred and forty pounds holding the double walled conduit together. About 2–8 turns per inch have been formed satisfactory. The more wrappings, or turns, of the winding 17 there are per unit of length, of course, the greater is the force holding the conduits together at the same wrapping force. If desired, the winding 17 can be substantially continuous such that each winding is contiguous an adjacent winding to increase the force holding the tubes together, as well as reinforce the thin walls of the tubing. On the other hand, the use of less than continuous windings, as illustrated, allows more economical assembly.

The windings 17 are only affixed to the tubings at periodic intervals to prevent unwinding if the bundle is cut. The affixing may be by any of the conventional means. For example, compression rings, compression clamp, lengths of heat shrunk plastic skin and bonding either thermally or adhesively may be employed for the affixing. If heat shrunk skin is employed, it may be continuous or discontinuous. One of the advantages of the continuous heat shrunk polybutylene skin is that it serves as an excellent form of insulation. If the bonding is employed at intervals, it may be by adhesives such as the catalytically set thermoplastic materials or by solder. The solder may be silver solder or other forms of adhesive that will bind the winding to the wall of the tubing at a local site, and not to enhance heat transfer.

The windings may comprise any form of material that is able to sustain the requisite pressure to hold the tubing together. Preferably, the windings 17 are heat conductive such as formed of a heat conductive metal like copper, aluminum, or steel. The windings 17 may comprise cylindrical wire of circular cross section. As illustrated, it comprises copper wire of cross sectional shape having a width in the range of 0.050–0.125 inch and a thickness in the range of 0.02–0.04. When the windings are heat conductive, additional conduction is provided from the other heat conductive wall surface of the respective conduits into the walls of adjacent conduits.

As indicated hereinbefore, it is preferred that the windings be affixed at a plurality of points along the length of the tubings so that the tubings and winding combination can be cut into any desired length for forming heat exchangers without having the winding unwind from the tubings.

Figure 5:
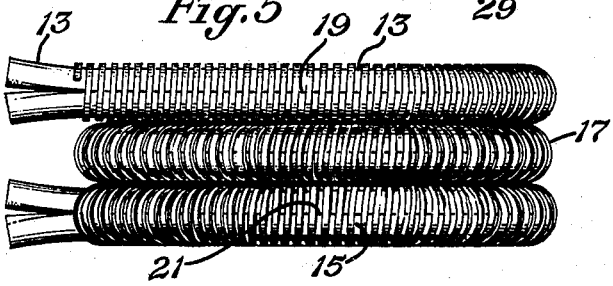
FIG. 5 is side elevational view of the heat exchanger of FIG. 1 coiled into a small coiled heat exchanger configuration.
Figure 6:
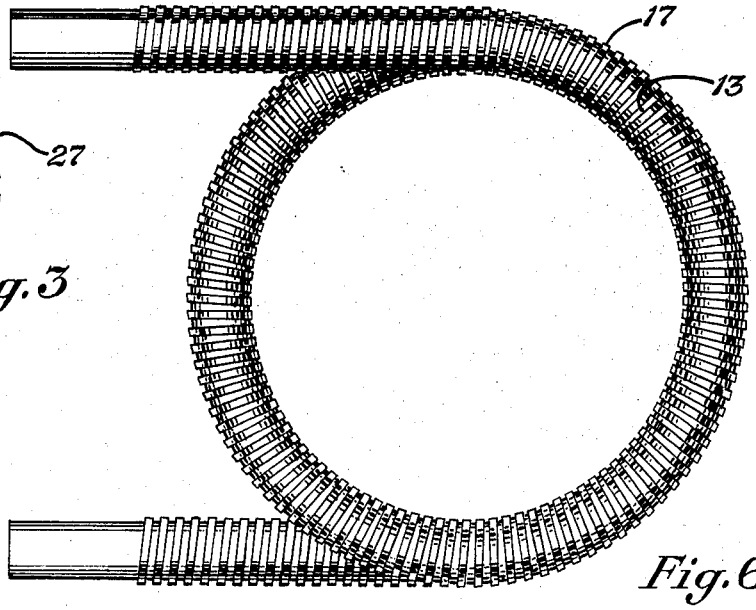
FIG. 6 is a top view of the embodiment of FIG. 5.

Referring to FIG. 5, the heat exchanger 11 which has been formed as illustrated in FIGS. 1–4, is, subsequently, coiled in the form of a coil for compact heat exchangers arrangement. It is noteworthy that the plane of the areas of contacts 19, 21 of the conduits 13 and 15 lie in the plane of the coil. It has been found vital to keep this parallel planar arrangement to achieve the enhanced heat transfer capabilities of this invention. If the plurality of conduits are allowed to twist, there is an apparent loosening of the areas of contact 19 and 21 and loss in heat transfer capability. As can be seen in FIG. 6, the coil of conduits 13 and the respective winding 17 have a propensity for the windings to radiate outwardly like the spokes of a wheel. To insure that the enhanced heat transfer capability is still achievable, it has been found advantageous to pressurize the conduits 13 and 15, as by subjecting them to a sufficient hydraulic pressure to expand their walls outwardly against the respective windings 17 and the areas of contact 19 and 21. The expansion of the walls outwardly against the windings effects helical markings in the interior walls of the conduits for favorable heat transfer flow patterns.

In operation, the two D-tube conduits 13, 15 are placed back to back and the windings 17 have one end affixed to the tubes and are spirally, or helically, wound onto and around the tubes while they are contiguous each other and parallel. A plurality of points of affixing are employed on the windings so that the tubing may be cut to any length. Of course, if desired, the affixings, shown for example by bonding spots 29 can be employed to hold the windings 17 in place on a predetermined cut length if desired. In mass production, however, it is preferable to affix at a plurality of spots, such as each six inches or a foot. The affixing is preferably by compressive rings, clamps or bonding. The bonding may be any of the bonding that is conventional in this art and range from chemical bonding such as the catylytic bonding effected by polyacrylate, poly epoxy and the like with their respective catalysts to the brazing, silver soldering and the like. Ordinarily, soldering is adequate to hold the winding in place. The winding 17 may be emplaced by winding around the tubing with the tubing rotated if desired. This is simple and straight forward and enables holding a predetermined force. It is preferable, however, that the winding be emplaced with a winding head. For example, a winding head may wind around the bundle of conduits with the desired tension on the winding. If desired, a plurality of lineal windings can be employed with the respective plurality of angles on each of the helical turns increased to allow intermediate windings of a different strand if desired. In any event, the desired length of the heat exchanger is formed into the desired, shape, as into the coil. Of course, the linear heat exchanger can be employed if desired.

It is advantageous to insure that the windings are tight on the respective conduit. For example, if coiled into a coil heat exchanger, it is advantageous to pressurize the tubes to force the walls out against the windings and against the areas of contact 19, 21 for the desired efficiency in heat transfer.

The respective ends of the conduits can then be fitted with conventional fitting for connecting with the respective fluid circuits. For example, the conduits may be expanded into circular cross sectional shape for being fitted onto the conventional plumbing fittings, such as unions, ells, threaded receptacles, valves and the like. If, on the other hand, conventional cylindrical tubing of circular cross section is employed and flattened on one side for being emplaced adjacent a flattened side of an adjacent conduit, the ends are simply left circular in cross sections to facilitate connection into the fluid path for the respective fluids. As indicated hereinbefore these fluids may comprise refrigerant, aqueous solutions, hot water or the like. The resulting heat exchangers have been found to be surprisingly effective in transferring heat between the fluids.

A variety of other embodiments can be employed. For example, a relatively large conduit can be employed with a smaller conduit held together in a unitary bundle by windings which may have the same configuration described hereinbefore with respect to the windings. The conduits may have respective flattened areas for matingly being placed contiguous each other. Thus, the heat conduction path has a much larger area than the line of contact of the prior art. Also the windings will increase the heat conduction if they are themselves conductive. This configuration is particularly useful where a high heat capacity, highly efficient heat transfer fluid; such as, a refrigerant; is heat exchanged with another fluid; such as, an aqueous solution of ethylene gylcol or the like; the latter being placed in the larger conduit.

As will be apparent to one skilled in the art, more than two tubes can be emplaced contiguous each other in accordance with this invention. It is particularly desirable, however if the resulting double wall heat exchanger is a standard shape, such as circular in cross section such that standard insulation can be employed.

The following example illustrates one embodiment of this invention that has been found eminently satisfactory.

EXAMPLE I

In this example, soft copper D-tubing of annealed copper having a wall thickness of about 0.032 inch and having a nominal outside diameter of about 0.875 inch was emplaced adjacent and contiguous a similar copper tube. Copper windings having width in the range of 0.050–0.125 and thickness in the range of 0.020–0.040 inch was wound around the tube with a wrap tension in the range of 10–100 pounds. About 2–8 turns of the wrap per inch of tubing were employed. The heat exchanger bundles were then coiled into respective coils of 11 inch diameter and tested, as well as being tested in the linear configuration. The test data were then compared.

For a comparative standard, that used was the one discussed in "Innovative Double Walled Heat Exchanger For Use In Solar Water Heating", S. A. Mumma, L. P. Milnarist and J. M. Rodriguez-Anza, Arizona State University, Tempe, Ariz. In that paper, in discussing the equation $Q=UA\Delta t$, an overall UA of 226 British Thermal Units per hour per °F. [Btu/hr.-°F.] was indicated to be satisfactory. With the foregoing design, a UA of 760 Btu/hour °F. was achieved for a twelve foot wrapped length with water on both sides flowing at 2.5/3.0 gallons per minute (gpm).

EXAMPLE II

When two D-tubes of a nominal maximum diameter of about $\frac{7}{8}$ inch were emplaced adjacent each other, there is a cross sectional flow area of 0.23 square inches, comparable to a round tube size of 0.5439 inch. Yet a surface area of 24.25 square inches per foot was provided instead of the surface area of 20.50 for the round tube design. The average distance between the center line of the D-tubes was only 0.437 compared to an average distance of 0.5439, or 19% decrease in distance; accompanied by the 18% increase in surface area.

From the foregoing, it can be seen that this invention provides the advantageous features specifically delineated hereinbefore and thereby achieves the objects delineated hereinbefore. In addition it provides the following features:

1. The basic feature of the proposed design is a spiral, wire wrapped outer sheeting which mechanically constrains multiple tubes of heat conductive metal together to form a double walled heat exchanger design.

2. The outer wire winding provides two distinct functions: (1) it mechanically holds the tubes together and (2) it provides heat transfer from the outer surface of the outer tubes not in contact with the adjacent tube, essentially like extended fins where the heat conduction path is greatly shortened.

3. It provides heat transfer via two paths, both conduction, where the windings are conductive.

4. It provides multiple fluid path circuits in a single bundle that can be readily formed into the desired shape for whatever storage space is available without requiring bundlesome packaging of heat exchangers.

5. The windings can be of round or flat ribbon type of cross sectional rectangular areas wound in single or multiple layers at any linear density to provide the requisite mechanical and thermal bond.

6. The tubing can be rolled to provide flat surfaces between the respective tubes at their adjacent and contiguous contact areas.

7. The tubing can be at room temperature while the wire can be wrapped at elevated temperatures if desired such that there is contraction and increase in tension upon cooling.

8. The windings may be under tension to provide a relatively high degree of force to hold the tubes contiguous each other for increased heat transfer. If desired, the tubes can be expanded under pressure for enhanced effectiveness in transferring heat.

9. If desired, one of the tubes can be spiralled about the other to achieve higher density of the spiral tube in term of linear feet per linear foot of the inner tube.

Also, the invention provides the following advantages in that the heat exchanger design:

1. Minimizes the temperature difference between the multiple flows, providing small heat conduction path;
2. Reduces size of the heat exchanger;
3. Minimizes the amount of material;
4. Reduces cost;
5. Uses currently available tubing and wire components at low cost;
6. Can be easily insulated since the resulting heat exchanger bundled can be emplaced within predesigned insulation of the desired size and put within conventional insulating coating; and
7. Can be easily shaped after forming, as by being coiled into the desired compact size and shape.

Although the invention has been described with a certain degree of particularity, it is understood that the present disclosure is made only by way of example and that numerous changes in the details of construction and the combination and arrangement of parts may be resorted to without departing from the spirit and the scope of the invention, reference for the latter being had to the appended claims.

I claim:

1. A double wall heat exchanger comprising:

a. a plurality of discrete conduits defining separate flow paths for respective fluids; said conduits having thin, heat conductive walls and being disposed contiguous another conduit; said conduits comprising a pair of conduits having respective D-shaped cross-section with the flattened areas of the D being placed back to back and contiguous each other for significant contact area rather than a mere line contact;

b. a plurality of windings per unit length holding said plurality of conduits in a bundle; said plurality of windings reinforcing said thin wall conduit walls and having respective tensile forces compressively holding said plurality of conduits contiguous adjacent conduits with said plurality of windings effecting a plurality of respective effective force vectors per unit length; and c. a lineal member traversing longitudinally intermediate the contiguous flattened areas.

2. A double wall heat exchanger comprising:

a. a plurality of discrete conduits defining separate flow paths for respective fluids; said conduits having thin, heat conductive walls and being disposed contiguous another said conduit; said conduits having respective flattened areas emplaced contiguous each other for significant contact area rather than a mere line contact;

b. a plurality of windings per unit length holding said plurality of conduits in a bundle; said plurality of windings reinforcing said thin wall conduit walls and having respective tensile forces compressively holding said plurality of conduits contiguous adjacent conduits with said plurality of windings effecting a plurality of effective force vectors per unit of length; and c. a lineal member traversing longitudinally intermediate the contiguous flattened areas.

* * * * *